US006321859B1

(12) United States Patent
Boyd

(10) Patent No.: US 6,321,859 B1
(45) Date of Patent: Nov. 27, 2001

(54) BLASTHOLE DRILL WITH BI-MATERIAL ROLLER FOR SUPPORTING A LOAD

(75) Inventor: James W. Boyd, New Berlin, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 09/411,707

(22) Filed: Oct. 1, 1999

(51) Int. Cl.[7] ..... E21B 19/14

(52) U.S. Cl. ..... 175/85; 152/5; 295/11; 301/40.2; 384/58

(58) Field of Search ..... 175/85; 301/5.1, 301/5.3, 40.2; 295/1, 7, 11, 31.1; 492/30; 104/242, 245, 246, 307; 384/58

(56) References Cited

U.S. PATENT DOCUMENTS 285,783 * 10/1883 Ballou ..... 301/5.3
285,836 * 10/1883 Otis ..... 301/5.3
622,391 * 4/1899 Rankin et al. ..... 301/5.3
1,542,103 * 6/1925 Shoemaker ..... 301/5.3
2,049,268 * 7/1936 Ludwick ..... 301/39.1
2,410,209 * 10/1946 Godsey ..... 301/39.1
2,873,150 * 2/1959 Hutzelman ..... 384/19
3,464,744 * 9/1969 Fall ..... 384/19
5,622,232 * 4/1997 Whisenhunt ..... 175/85

* cited by examiner

*Primary Examiner*—William Neuder
(74) *Attorney, Agent, or Firm*—David R. Price

(57) ABSTRACT

A roller is designed for adaptation into a blasthole drill and is specifically designed for use in conjunction with a rotary carriage to allow the carriage to move up and down a blasthole drill mast as needed. The roller is made of a substantially non-deformable material combined with a deformable material. Under light loads, the deformable material contacts and supports the load to provide enhanced operation of the roller. Under heavy loads, the deformable material advantageously deforms to a point which allows the substantially non-deformable material and deformable material to contact and cooperatively support the load.

18 Claims, 3 Drawing Sheets

BLASTHOLE DRILL WITH BI-MATERIAL ROLLER FOR SUPPORTING A LOAD

FIELD OF THE INVENTION

The present invention relates generally to blasthole drills and to rollers for supporting a load and, more particularly, to rollers made of more than one material. Specifically, the present invention relates to a bi-material roller for use in a blasthole drill.

BACKGROUND OF THE INVENTION

There are many known rollers or wheels designed for supporting a load. For example, U.S. Pat. No. 1,408,388 to Reddaway et al. is directed to a tire and rim assembly wherein the tire includes a body portion formed of hard rubber and a central portion constituting a soft rubber resilient core. U.S. Pat. No. 1,687,113 to Stockdale describes a caster wheel formed with a rubber annulus and a tread or wear element in the shape of a disc which is fabricated of fibrous or fabric materials vulcanized to the rubber annulus. U.S. Pat. No. 4,321,727 to Sheiman et al. discloses a luggage roller including a central groove in the form of a V-shaped channel of elastomeric material and a central cylindrical sleeve formed of low friction material, such as polyethylene nylon, Teflon, or similar plastic. In U.S. Pat. No. 4,452,141 to Mistyurik, a roller with a porous surface and a central flange is disclosed. U.S. Pat. No. 5,803,235 to McGinnis et al. is directed to an idler roller which includes an impact shell with a backing layer on the inside of the shell, and a compression ring adapted to expand and engage the inside of the impact shell and an external surface of a main roller body. The load carrying capability of these types of rollers and other rollers varies as a result of their structural construction and intended use.

Blasthole drills are large machines used in mining operations to drill holes for explosives. A conventional blasthole drill comprises a frame supported by crawlers for movement over the ground. A mast which defines a drill hole axis is supported by the frame for movement between a substantially vertical position and a number of angled or non-vertical positions. A rotary head, which engages the upper end of a drill pipe for rotating the drill pipe and driving the drill pipe into the ground, moves relative to the mast along the drill hole axis. The rotary head is supported by rollers which move along appropriate surfaces or grooves in the mast. The rollers are designed to have a load carrying capacity to support, at a minimum, the weight of the rotary head and the weight of the end of the drill pipe supported by the rotary head. As can be appreciated, when the mast is positioned in a vertical or substantially vertical position, a light load is transferred to the rollers. On the other hand, when the rotary head is applying, a downward force for drinking, heavy load is transferred to the rollers.

It is known to make such rollers of an all-steel construction.

It is also known to provide rollers having a steel main body surrounded with an outer covering of plastic.

BRIEF SUMMARY OF THE INVENTION

A roller according to the present invention is adapted to support a load under any number of different applications. However, a roller according to the present invention is particularly useful in a blasthole drill.

Under certain load conditions, it may be advantageous for a roller to have particular load supporting and roller surface characteristics and yet, under other load conditions, it may be advantageous for the roller to have different load supporting and roller surface characteristics. The invention provides a roller which is capable of adapting its load supporting and roller surface characteristics as needed for different applications or changing load conditions.

Many of the known rollers or wheels, while capable of supporting loads under many different conditions, do not provide the desired versatility when it comes to subjecting the rollers or wheels to variable load conditions. In other words, such rollers or wheels do not include load supporting and roller surface characteristics which independently change on an as-needed basis depending on the load to be supported. Thus, a problem with these types of rollers or wheels is that while such rollers or wheels may satisfactorily operate when subjected to a given load, such rollers or wheels may not satisfactorily operate when subjected to a different load.

The known all-steel rollers for blasthole drills are capable of high load carrying capacity. However, a problem which exists for all steel rollers is that during light loading, the steel rollers may skid rather than roll, which may cause flat spots on the rollers, thereby adversely affecting the rollers capability to function properly and support the load. The load supporting and roller surface characteristics of the all-steel rollers do not adjust for changing load conditions.

The plastic covered rollers for blasthole drills were designed to address some of the problems associated with the all-steel rollers by providing a surface with better frictional properties for certain load conditions, particularly light load conditions. Nevertheless, a problem which exists for these types of rollers is that during heavy loading, the large loads may excessively compress the plastic coverings and cause the plastic to flow outward and over the edges or sides of the steel roller main body. Too large of a flow in the plastic can result in high stresses in the bond between the main body of the steel rollers and the plastic outer covering thereby possibly causing the bond to fail.

Accordingly, the present invention provides a roller that alleviates these problems and many other problems common to known rollers or wheels. More particularly, the present invention provides a bi-material roller which is capable of supporting various loads, i.e., light loads or heavy loads, and which is also designed to properly roll, rather than skid, under any given load condition. A bi-material roller according to the present invention is particularly capable of use in a blasthole drill which is notorious for subjecting load supporting rollers to various load conditions.

In one aspect of the present invention, there is provided a roller which is rotatable about its axis, and which is adapted to support a load. The roller includes a roller body having a first substantially non-deformable, generally cylindrical outer surface located radially outward with respect to the roller axis. The roller further includes a second deformable, generally cylindrical outer surface located radially outward with respect to the roller axis.

The outer surfaces are configured and arranged such that under a light load condition, the second deformable surface extends farther radially outward than the first substantially non-deformable surface. Under such a light load condition, the deformable surface of the roller is in contact with and supports the load while the substantially nondeformable surface of the roller is not in contact with and does not support the load. The surface properties of the deformable material allow the roller to roll under light loads whereas, as pointed out, an all steel roller may undesirably skid under such load conditions.

The outer surface of the rollers are further configured and arranged such that under a heavy load condition, the second deformable surface deforms to a point where the second surface does not extend farther radially outward than the first substantially non-deformable deformable surface. Under such a heavy load condition, both the deformable and substantially non-deformable surfaces are in contact with and cooperatively support the load. The non-deformable surface ensures that the roller is capable of supporting the heavy load while, at the same time, the roller is constructed so as to prevent the deformable surface from being overstressed or deformed beyond an acceptable range. A roller according to the present invention is unlike the prior plastic covered rollers which may perform in a less than acceptable manner if subjected to heavy loads as previously discussed.

In a preferred embodiment, the roller body and thus the first substantially non-deformable surface is made of steel and the second deformable surface is made of plastic.

In one aspect of the present invention, there is provided a deformable material which includes the second deformable surface. At least a portion of the deformable material mates against a portion of the main roller body. In another aspect of the present invention, the main roller body includes an annular groove wherein at least a portion of the deformable material is positioned.

According to another aspect of the present invention, there is an open, annular area defined between a portion of the deformable material and a portion of the main roller body. Thus, as the deformable material is caused to deform, at least a portion of the deformable material or second surface extends into or over the open area. However, the open area is configured between the respective surfaces such that under heavy loads, the deformable material is prevented from deforming beyond an acceptable range.

In a preferred embodiment, there is provided a roller having a second deformable material including a third deformable, generally cylindrical outer surface located radially outward with respect to the roller axis, wherein the first substantially non-deformable surface is located between the second and third deformable surfaces. In this embodiment, under a light load condition, the second and third surfaces extend father radially outward than the first surface so that the second and third surfaces are in contact with and support the load while the first surface is not in contact with and does not support the load. Moreover, under a heavy load condition, the second and third surfaces deform to a point where the second and third surfaces do not extend farther radially outward than the first surface so that the first, second and third surfaces are in contact with and cooperatively support the load.

In accordance with one aspect of the present invention, the main roller body is made of steel and the deformable material is made of plastic. In another aspect, the main roller body is provided with an additional annular groove adapted to receive at least a portion of the second deformable material. In a preferred arrangement, the main roller body is provided with another open area adapted to accommodate the expansion of the second deformable material or third deformable surface in much the same manner as the first open area is adapted to accommodate the first deformable material or second deformable surface. In a highly preferred embodiment, a roller according to the principles of the present invention is adapted for use in a blasthole drill.

Other features and advantages of the invention will become apparent to those skilled in the art upon review of the following detailed description, claims and drawings in which like numerals are used to designate like features.

Figure 1:
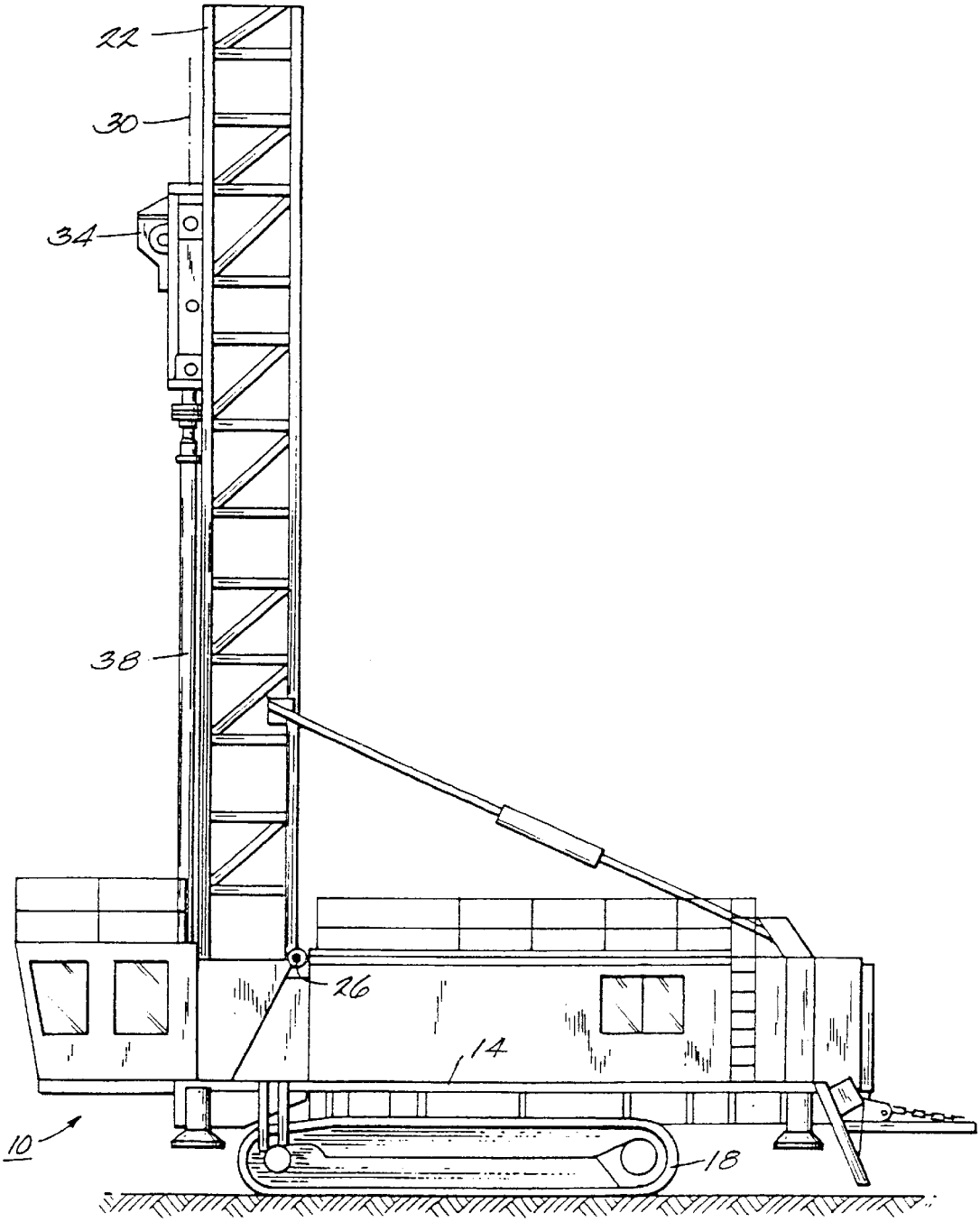
FIG. 1 is a side elevational view of a blasthole drill in which the present invention is employed.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DESCRIPTION OF THE PREFERRED EMBODIMENTS

Illustrated in FIG. 1 is a blasthole drill 10 in which the present invention is employed. It being understood that a roller according to the principles of the present invention is capable of use in other blasthole drills and in other constructions where the roller is designed to support a load, including those constructions where the supported load varies from time to time. The blasthole drill 10 comprises a frame 14 supported by crawlers 18 for movement over the ground. A mast 22 is supported by the frame 14 for movement relative thereto about a generally horizontal axis 26 and between a substantially vertical position (shown in FIG. 1) and a number of angled or non-vertical positions (not shown). The mast 22 defines a drill hole axis 30. A rotary head 34 is movable relative to the mast 22 along the drill hole axis 30. The rotary head 34 is selectively engageable with the upper end of a drill pipe 38 supported relative to the mast 22. The rotary head 34 includes at least one roller attached thereto and adapted to ride in grooves (not shown) found in the mast 22. As will be further explained, the rollers are designed to support the load of the rotary head 34, drill pipe 38 and associated components during non-operation and during operation of the blasthole drill 10. The frame 14, crawlers 18, mast 22 rotary head 34 and drill pipe 38 are of conventional construction and do not require a detailed description. Known blasthole drills are described, for example, in U.S. Pat. Nos. 5,622,232 and 5,653,297 both to Whisenhunt.

Figure 2:
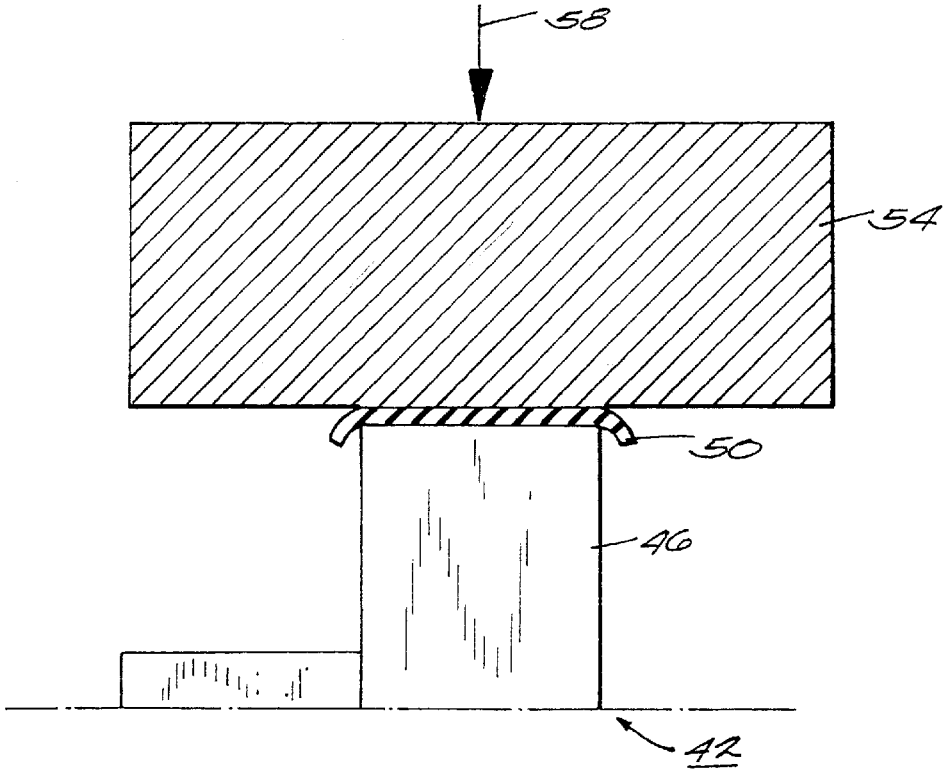
Fig. 2. PRIOR ART
FIG. 2 is a perspective view of a prior art plastic covered steel roller subjected to a heavy load.

Referring to FIG. 2, a known plastic covered steel roller 42 as previously mentioned is shown. Illustrated is a main steel roller body 46 surrounded by a plastic outer covering 50. Although not shown, a prior all steel roller would comprise the main steel roller body 46 without the plastic covering 50. The plastic outer covering 50 is applied to and adheres to the main steel roller body 46 according to conventional methods known to those skilled in the art. Typically, an adhesive is used to create a bond between the plastic outer covering 50 and main roller body 46. Cross-sectioned box 54 represents a load supplied to the roller 42 by the rotary head 34, drill pipe 38 and other components as shown, for example, in FIG. 1. Arrow 58 indicates that the box or load supplying member 54 causes a force to be exerted against the roller 42, specifically, against the outer surface of the roller 42. As shown, under a heavy load, the plastic outer covering 50 is caused to extrude out past the sides of the roller 42. Flow is referred to as the condition when a load causes the plastic outer covering 50 to slide along the mating surface between the plastic covering 50 and main steel roller body 46. Too large of flow in the plastic outer covering 50 as a result of high loading causes high stresses in the bond between the main steel roller body 46 and plastic outer covering 50 causing failure of the bond. Once the bond between the main steel roller body 46 and plastic outer covering 50 is broken, the overall performance of the roller 42 may be detrimentally affected leading to premature failure of the roller 42 or unsatisfactory operation of the roller 42. It should be noted that, unlike plastic covered rollers, although all steel rollers are quite capable of handling heavy loads, all steel rollers may not roll as desired when under light loading conditions as previously set forth.

Figure 3:
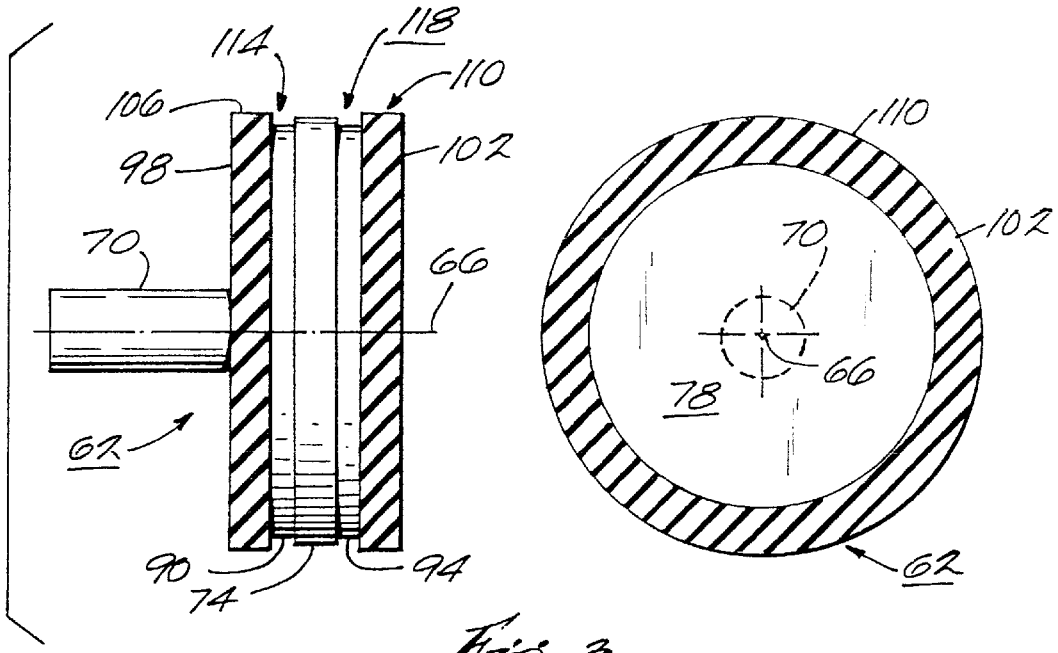
FIG. 3 illustrates perspective side and front views of a bi-material roller according to the present invention.

FIG. 3 illustrates a bi-material roller 62 according to the present invention which solves the problems of the prior blasthole drill rollers and other problems associated with other rollers. The roller 62 may be attached to the rotary head 34 shown in FIG. 1 in a suitable manner. The roller 62 is adapted to support a load and is rotatable about axis 66 which travels through a shaft 70. Illustrative views of the roller 62 supporting different loads are shown and further described with reference to FIGS. 4 and 5 below.

The roller 62 includes a main roller body 78 which includes a first substantially non-deformable, generally cylindrical outer surface 74 located radially outward with respect to the axis 66. Preferably, the roller body 78 and thus the surface 74 are made of steel. In the illustrated construction, the main roller body 78 includes a pair of annular grooves 82 and 86 (see FIGS. 4 and 5) spaced apart in the direction of the axis 66. The bottoms of the grooves 82 and 86 are located radially inward as compared to the surface 74 with respect to axis 66. A pair of steps or shelves 90 and 94 which are parallel to axis 66 extend between the inwardly cut grooves 82 and 86, respectively, and raised outer surface 74. The steps or shelves 90 and 94 are located farther radially outward than the bottoms of grooves 82 and 86 but not as far radially outward as the outer surface 74 (see FIGS. 4 and 5).

The roller 62 also includes a pair of deformable, annular parts or members 98 and 102 seated in the grooves 82 and 86, respectively, of the main roller body 78. Preferably, the deformable parts 98 and 102 are made of a deformable plastic material suitable for use according to the principles of the present invention. The deformable materials 98 and 102 may be applied to and caused to adhere to the main roller body 78 according to any number of suitable methods. The deformable parts 98 and 102 respectively include generally cylindrical outer surfaces 106 and 110 which are located radially outward with respect to the axis 66. As best shown in FIG. 3, the outer surfaces 106 and 110 extend farther radially outward than the outer surface 74, the purpose of which will be further explained below. As shown, the deformable parts 98 and 102 extend above the grooves 82 and 86 and beyond the steps or shelves 90 and 94 thereby defining open areas 114 and 118 respectively located on either side of the first raised outer surface 74. The function of the open areas 114 and 118 will be discussed in more detail below.

Figure 4:
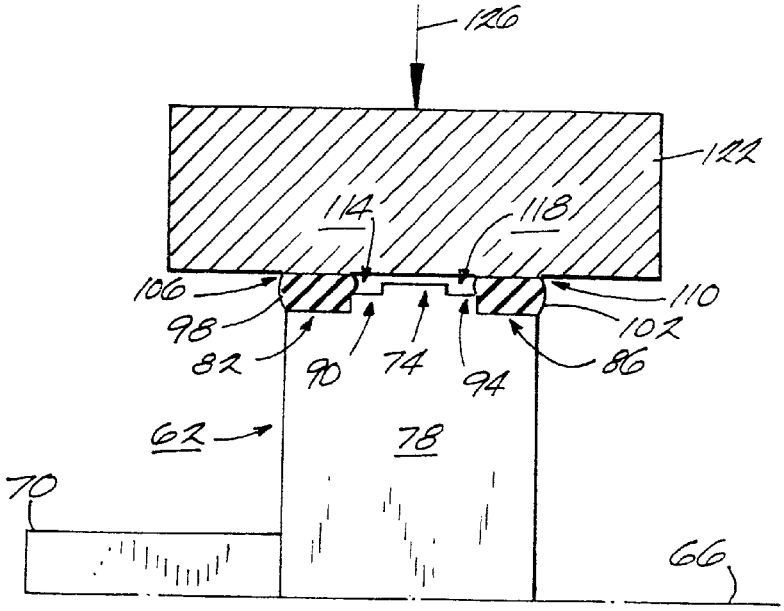
FIG. 4 is a perspective view of a bi-material roller according to the present invention under a light load condition.

FIG. 4 illustrates a roller 62 according to the present invention under a light load condition. Cross-sectioned box 122 represents the load supplied by the rotary head 34, drill pipe 38 and other components as shown in FIG. 1. However, box 122 can represent any load supplying member. Arrow 126 indicates that box or load supplying member 122 causes a force to be exerted upon the roller 62. As shown, under a light load condition, the deformable materials 98 and 102 may be slightly compressed. However, under a light load condition, the deformable outer surfaces 106 and 110 remain extended farther radially outward than the substantially non-deformable outer surface 74. Under such a light load condition, the properties of the outer surfaces 106 and 110 ensure that the roller 62 properly rolls along a surface such as a groove found in the mast 22 of blasthole drill 10 as such is shown in FIG. 1. As can be observed, the deformable surfaces 106 and 110 contact and support the load 122 while the non-deformable surface 74 does not contact and does not support the load 122. Thus, unlike prior art steel rollers which may skid under light load conditions, the bi-material roller constructed according to the principles of the present invention rolls as desired.

Figure 5:
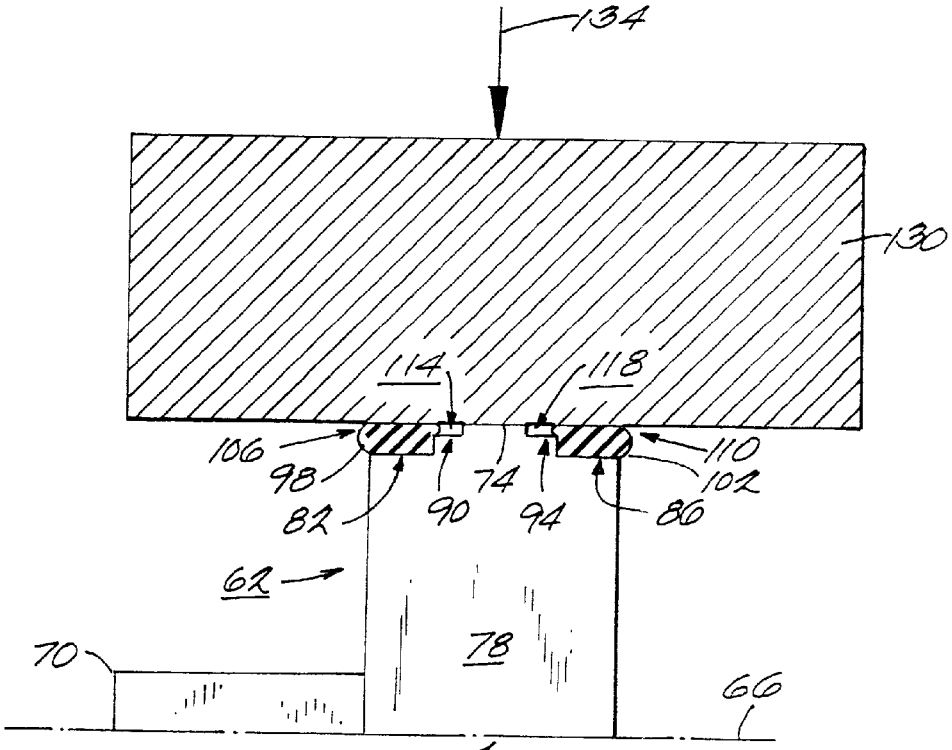
FIG. 5 is a perspective view of a bi-material roller according to the present invention under a heavy load condition.

FIG. 5 illustrates the roller 62 according to the present invention under a heavy load condition. Box 130 is similar to box 122 of FIG. 4 except that it supplies a greater load, as shown by arrow 134, to the roller 62 as compared to box 122. As explained, such a situation may occur when a mast 22 of a blasthole drill 10 is located in a non-vertical position. As shown, under a heavy load condition, the deformable materials 98 and 102 are compressed a greater amount as compared to the compression shown in FIG. 4. As illustrated, the deformable materials 98 and 102 deform to a point such that the outer surfaces 106 and 110 do not extend farther radially outward than the first surface 74 with respect to axis 66. Thus, the outer surfaces 106 and 110 as well as outer surface 74 contact and support the load 130. As the deformable materials 98 and 102 are compressed, at least portions of the deformable materials 98 and 102 expand into the respective open areas 114 and 118. Unlike the prior plastic covered rollers which may be adversely affected under heavy loads causing the plastic to deform beyond an acceptable amount, the open areas 114 and 118 are adapted to ensure that the deformable parts 98 and 102 of the roller 62 are not caused to flow beyond an acceptable limit.

Variations and modifications of the foregoing are within the scope of the present invention. For example, the rollers may include a single deformable part or multiple deformable parts. Also, one configuration of a roller according to the present invention could include a deformable part positioned between a pair of non-deformable outer surfaces of a non-deformable roller body. Moreover, the open areas may be defined in any number of different ways so long as the deformable material has a place to go when deformed and, so long as the deformable material is prevented from being overstressed under heavy loads. Further, a roller according to the present invention may be adapted for use in many other applications other than a blasthole drill according to the principles of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A roller for supporting a load, said roller being rotatable about an axis, said roller comprising:

a roller body including a first substantially non-deformable, generally cylindrical outer surface located radially outward with respect to said axis, and an annular groove, a deformable material, at least a portion of which is located within said groove, said deformable material including a second deformable, generally cylindrical outer surface located radially outward with respect to said axis, such that under a light load condition, said second surface extends farther radially outward than said first surface so that said second surface contacts and supports the load and said first surface does not contact and does not support the load, and such that under a heavy load condition, said deformable material deforms to a point where said second surface does not extend farther radially outward than said first surface so that said first surface and said second surface contact the load and cooperatively support the load, and an open area defined between a surface of said deformable material and a surface of said roller body such that, as said deformable material deforms, at least a portion of said deformable material extends into said open area.

2. A roller according to claim 1, wherein said roller body is made of steel.

3. A roller according to claim 1, wherein said deformable material is plastic.

4. A roller according to claim 1, wherein said deformable material mates against said roller body.

5. A roller according to claim 1, further including a second deformable material including a third deformable, generally cylindrical outer surface located radially outward with respect to said axis, and wherein said first outer surface is located between said second and third outer surfaces such that under a light load condition, said second and third outer surfaces extend farther radially outward than said first outer surface so that said second and third outer surfaces contact and support the load and said first outer surface does not contact and does not support the load, and such that under a heavy load condition, said first and second deformable materials deform to a point where said second and third outer surfaces do not extend farther radially outward from said first surface so that said first, second and third surfaces contact the load and cooperatively support the load.

6. A roller according to claim 5, wherein said roller body is made of steel.

7. A roller according to claim 5, wherein said first and second deformable materials are plastic.

8. A roller according to claim 5, wherein said roller body further includes first and second spaced apart annular grooves such that at least a portion of said first deformable material is positioned within said first groove and such that at least a portion of said second deformable material is positioned within said second groove.

9. A roller according to claim 8, further including first and second spaced apart open areas, said first open area being defined by a surface of said first deformable material and a surface of said roller body and, said second open area being defined by a surface of said second deformable material and another surface of said roller body such that as said first and second deformable materials deform, at least portions of said first and second deformable materials extend into said respective open areas.

10. A roller according to claim 9, wherein said first open area is further defined by a first shelf on said roller body between said outer surface of said roller body and said first groove, and wherein said second open area is further defined by a second shelf on said roller body between said outer surface of said roller body and said second groove.

11. A roller according to claim 10, wherein said first outer surface is radially outward relative to said first and second shelves, and wherein said first and second shelves are radially outward relative to said first and second grooves.

12. A roller for supporting a load, said roller being rotatable about an axis, said roller comprising:

a main roller body defining a first substantially non-deformable, generally cylindrical outer surface located radially outward with respect to said axis, said main roller body further including first and second spaced apart annular grooves located on opposite sides of said outer surface so as to define respectively therebetween a first shelf and a second shelf, wherein said first outer surface is radially outward relative to said first and second shelves, and wherein said first and second shelves are radially outward relative to said first and second grooves;

a first deformable material including a first deformable, generally cylindrical outer surface located radially outward with respect to said axis, wherein at least a portion of said first deformable material is positioned within said first groove; and a second deformable material including a second deformable, generally cylindrical outer surface located radially outward with respect to said axis, wherein at least a portion of said second deformable material is positioned within said second groove, wherein a first open area is defined by a surface of said first deformable material and a surface of said roller body and said first shelf, and wherein a second open area is defined by a surface of said second deformable material and another surface of said roller body and said second shelf, and wherein said non-deformable outer surface is located between said first and second deformable outer surfaces, such that under a light load condition, said first and second deformable outer surfaces extend farther radially outward than said non-deformable outer surface so that said first and second deformable outer surfaces contact and support the load and said non-deformable outer surface does not contact and does not support the load, and such that under a heavy load condition, said first and second deformable outer surfaces deform to a point where said first and second deformable outer surfaces do not extend farther radially outward from said non-deformable outer surface so that said deformable outer surfaces and said non-deformable outer surfaces contact and cooperatively support the load, whereby as said first and second deformable materials deform under increasing load conditions, at least portions of said first and second deformable materials extend into said respective open areas.

13. A blasthole drill comprising:

a frame supported for movement over a ground surface;

a mast supported by said frame, said mast defining a drill hole axis which is adjustable along a vertical; and a rotary head movable relative to said mast along said drill hole axis, wherein one of said rotary head and said mast includes a roller for movement along the other of said rotary head and said mast, said roller being rotatable about a roller axis, said roller further including a roller body having a first substantially non-deformable, generally cylindrical outer surface located radially outward with respect to said roller axis, and a deformable material including a second deformable, generally cylindrical outer surface located radially outward with respect to said roller axis, such that when said drill hole axis is substantially vertical, said second surface extends farther radially outward than said first surface so that said second surface contacts and supports said rotary head relative to said mast and said first surface does not contact said other of said rotary head and said mast and does not support said rotary head relative to said mast, and such that when said drill hole axis is substantially non-vertical, said second surface deforms to a point where said second surface does not extend farther radially outward than said first surface so that said first surface and said second surface contact said other of said rotary head and said mast and cooperatively support said rotary head relative to said mast.

14. A blasthole drill according to claim 13, wherein said roller further includes a second deformable material including a third deformable, generally cylindrical outer surface located radially outward with respect to said axis, and wherein said first outer surface is located between said second and third outer surfaces such that under a light load condition, said second and third outer surfaces extend farther radially outward than said first outer surface so that said second and third outer surfaces contact and support said rotary head relative to said mast and said first outer surface does not contact said other of said rotary head and said mast and does not support said rotary head relative to said mast, and such that under a heavy load condition, said first and second deformable materials deform to a point where said second and third outer surfaces do not extend farther radially outward from said first surface so that said first, second and third surfaces contact said other of said rotary head and said mast and cooperatively support said rotary head relative to said mast.

15. A blasthole drill according to claim 14, wherein said roller further includes first and second spaced apart annular grooves such that at least a portion of said first deformable material is positioned within said first groove and such that at least a portion of said second deformable material is positioned within said second groove.

16. A blasthole drill according to claim 15, wherein said roller further includes first and second spaced apart open areas, said first open area being defined by a surface of said first deformable material and a surface of said roller body and, said second open area being defined by a surface of said second deformable material and another surface of said roller body such that as said first and second deformable materials deform, at least portions of said first and second deformable materials extend into said respective open areas.

17. A blasthole drill according to claim 16, wherein said roller is further defined by a first shelf on said roller body between said first surface of said roller body and said first groove, and wherein said second open area is further defined by a second shelf on said roller body between said other surface of said roller body and said second groove.

18. A blasthole drill according to claim 17, wherein said first outer surface is radially outward relative to said first and second shelves, and wherein said first and second shelves are radially outward relative to said first and second grooves.

* * * * *